US006154965A

United States Patent [19]

Sakai

[11] Patent Number: 6,154,965

[45] Date of Patent: Dec. 5, 2000

[54] KNIFE HAVING A LOCKING SYSTEM

[76] Inventor: Susumu Sakai, 6-49 Hiraga-choo Seki-city, Gifu-prefecture, Japan

[21] Appl. No.: 09/256,907

[22] Filed: Feb. 23, 1999

[30] Foreign Application Priority Data

Nov. 9, 1995 [JP] Japan ..... 10-334954

[51] Int. Cl.[7] ..... B26B 1/04

[52] U.S. Cl. ..... 30/161; 30/160

[58] Field of Search ..... 30/160, 161, 330, 30/331

[56] References Cited

U.S. PATENT DOCUMENTS 543,943 8/1895 Minter ..... 30/160

4,979,301 12/1990 Walker ..... 30/161

*Primary Examiner*—Douglas D. Watts

*Attorney, Agent, or Firm*—Kolisch Hartwell Dickinson McCormack & Heuser

[57] ABSTRACT

A knife of which the blade is brought into or out of a haft by revolving against the haft, having a locking system fixing the blade to the haft in usable condition by a hand, is provided with a function that not only bringing the blade into or out of the haft but also the action and the release of the locking system can be done only by one hand. The operation knob 11 is attached to a part of the blade 9 where a thumb of a hand holding the haft 2 can operate the operation knob 11. The action and the release of the locking system are determined in accordance with a direction of the force added to the operation knob 11 toward the direction of the blade 9 being brought into or out of the haft 2. The operation knob 11 is added force by a thumb of a hand holding the haft 2 toward the direction of the blade 9 being brought into or out of the haft 2.

14 Claims, 5 Drawing Sheets

KNIFE HAVING A LOCKING SYSTEM

FIELD OF INVENTION

The present invention pertains to a knife of which the blade is brought into or out of a haft by revolving, and in particular to a knife having a locking system fixing its blade to its haft in usable condition by a hand.

BACKGROUND OF INVENTION

To date, there are disclosed some types of knives having a locking system fixing their blade to their haft in usable condition by a hand. An operation knob to operate the locking system is attached to the haft. For this reason, as bringing the blade into or out of the haft, the locking system is used by operating the operation knob attached to the haft in addition to bringing the blade into or out of the haft directly.

However, to use all of those kinds of knives of which the system to bring the blade into or out of the haft can be operated only when the operation knob is given force to operate the locking system in addition to being given the other force to bring the blade into or out of the haft directly, both hands have had to be used. In addition to this, those knives have not been able to be used, especially when the alternative hand is not able to be used for the reason of holding something and so on.

SUMMARY AND OBJECTS OF INVENTION

It is an object of the present invention to provide a knife improved from a knife of which the blade is brought into or out of a haft by revolving against the haft and having a locking system fixing the blade to the haft in usable condition by a hand, to a knife of which the all functions can be used by one hand; not only operating the locking system but also bringing the blade into or out of the haft and so on.

The knife having a locking system of claim 1 of the invention is a knife of which the blade is brought into or out of a haft by revolving against the haft, having a locking system fixing the blade to the haft in usable condition by a hand, characterized by an operation knob attached to the blade to operate the locking system.

According to the knife having a locking system of claim 1 of the invention, the operation knob is attached to the blade directly, thus a series of actions can be done that the blade is brought into or out of a haft, the blade is fixed to the haft in usable condition by a hand, and the blade is released from the state of being fixed to the haft, in accordance with a direction of the force added to the operation knob.

The knife having a locking system of claim 2 of the invention is a knife according to claim 1, characterized by the operation knob attached to a position where a hand holding the haft can operate the operation knob.

Here, the position where the operation knob is attached may be a position where the operation knob can be operated by a thumb of the hand holding the haft, another finger of the hand and so on.

According to the knife having a locking system of claim 2 of the invention, in addition to the same action of a knife having a locking system of claim 1, the operation knob can be operated by the hand holding the haft, thus a series of actions can be done that the blade is brought into or out of a haft, the blade is fixed to the haft in usable condition by the hand, and the blade is released from the state of being fixed to the haft, only by one hand.

The knife having a locking system of claim 3 of the invention is a knife according to claim 2, characterized by the operation knob attached to a position where a thumb of the hand holding the haft can operate the operation knob.

According to the knife having a locking system of claim 3 of the invention, in addition to the same action of a knife having a locking system of claim 2, the operation knob can be added force by a thumb which can move more easily and add more force than any other finger of the hand holding the haft.

The knife having a locking system of claim 4 of the invention is a knife according to one of claims 1 through 3, characterized by the locking system of which the action and release are determined in accordance with a direction of the force added to the operation knob so that the blade can be brought into or out of the haft.

According to the knife having a locking system of claim 4 of the invention, in addition to the same action of a knife having a locking system of claims 1 through 3, the blade can be brought out of the haft and fixed to the haft in usable condition by a hand only by adding force to the operation knob toward the direction of the blade being brought out of the haft, conversely the blade can be released from the state of being fixed to the haft and brought into the haft only by adding force to the operation knob toward the direction of the blade being brought into the haft.

The knife having a locking system of claim 5 of the invention is a knife of which the blade is brought into or out of a haft by revolving against the haft, characterized by: an operation knob attached to a part of the blade where the operation knob can be operated by a thumb of a hand holding the haft; a clasp supported to the blade so as to be moved parallel far and near a revolving axle of the blade in accordance with operations of the operation knob; a pin which fixes the blade so as not to revolve on the axle with the clasp when the clasp is moved near to the axle in condition that the blade is in usable position of revolving; an arc portion formed arc in shape round the axle at a part of the haft; a first female portion formed female in shape next to the arc portion in series toward a direction of the blade being brought into the haft by revolving; a second female portion formed female in shape next to the arc portion in series toward direction of the blade being brought out of the haft by revolving; a guided element touched to a guide consisted of the first female portion, the arc portion, and the second female portion with the clasp so as to be smoothly movable; and a pushing element pushing the clasp toward the axle.

Here, a roller having bearings can be selected as the guided element. But only the roller is not selected as the guided element. Any element is afforded as the guided element, if the element has the qualities to decrease friction of being touched to a guide so as to be smoothly movable, and to resist great many times of being touched to the guide so as to be smoothly movable for the period of many years' use as a typical knife's life at least.

According to the knife having a locking system of claim 5 of the invention, the clasp is pushed toward the axle of the blade by the pushing element, and the guided element touched to a guide consisted of the first female portion, the arc portion, and the second female portion with the clasp so as to be smoothly movable, thus the guided element is moved with the clasp along the guide in accordance with the locus of the blade moving between the position where the blade is brought into the haft, and the position where the blade is brought out of the haft in usable condition by a hand.

BRIEF DESCRIPTION OF THE DRAWINGS

A preferred form of the present invention is illustrated in the accompanying drawings in which:

FIG. 1(*b*) is a front elevation of a knife having a locking system of the present invention.

DETAILED DESCRIPTION

Figure 1A:
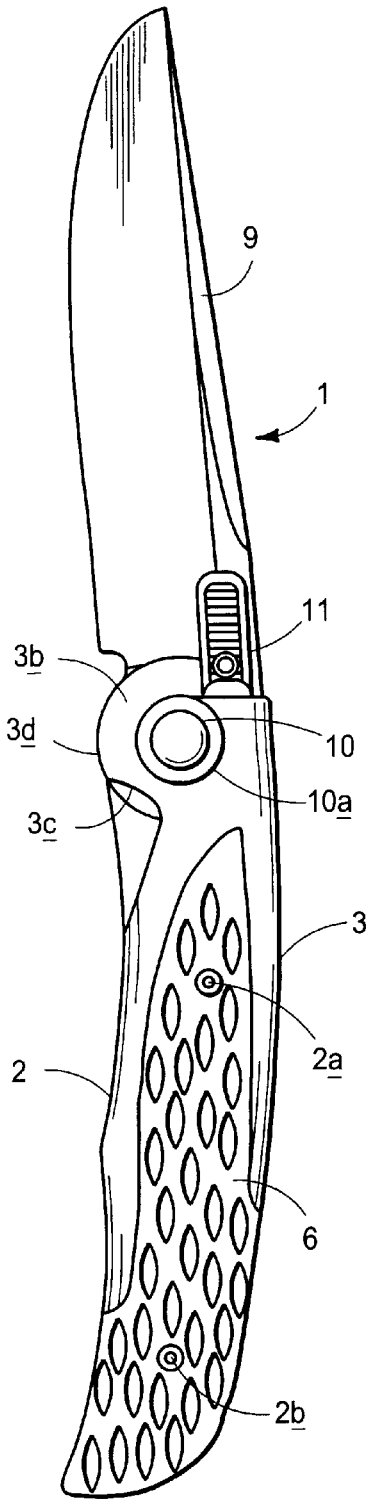
FIG. 1(*a*) is a right side elevation of a knife having a locking system of the present invention.
Figure 1B:
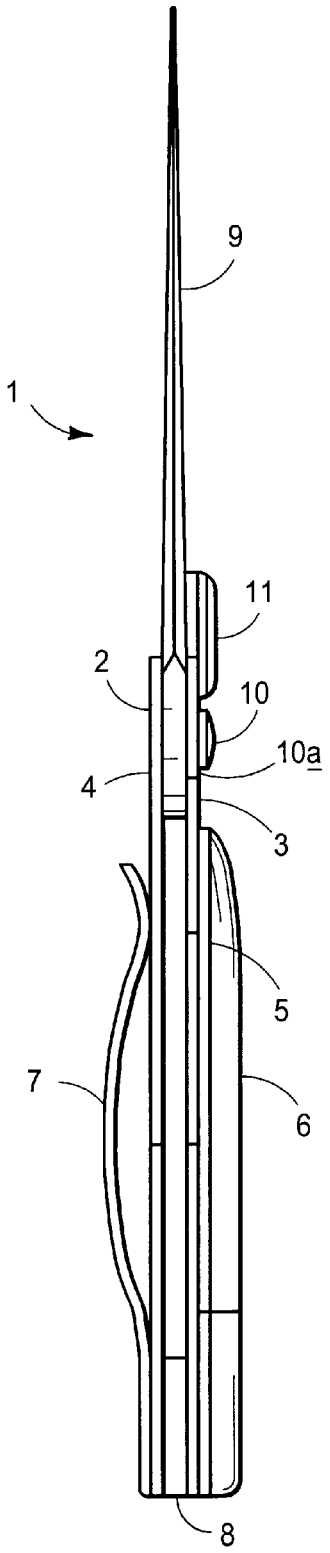
Figure 2:
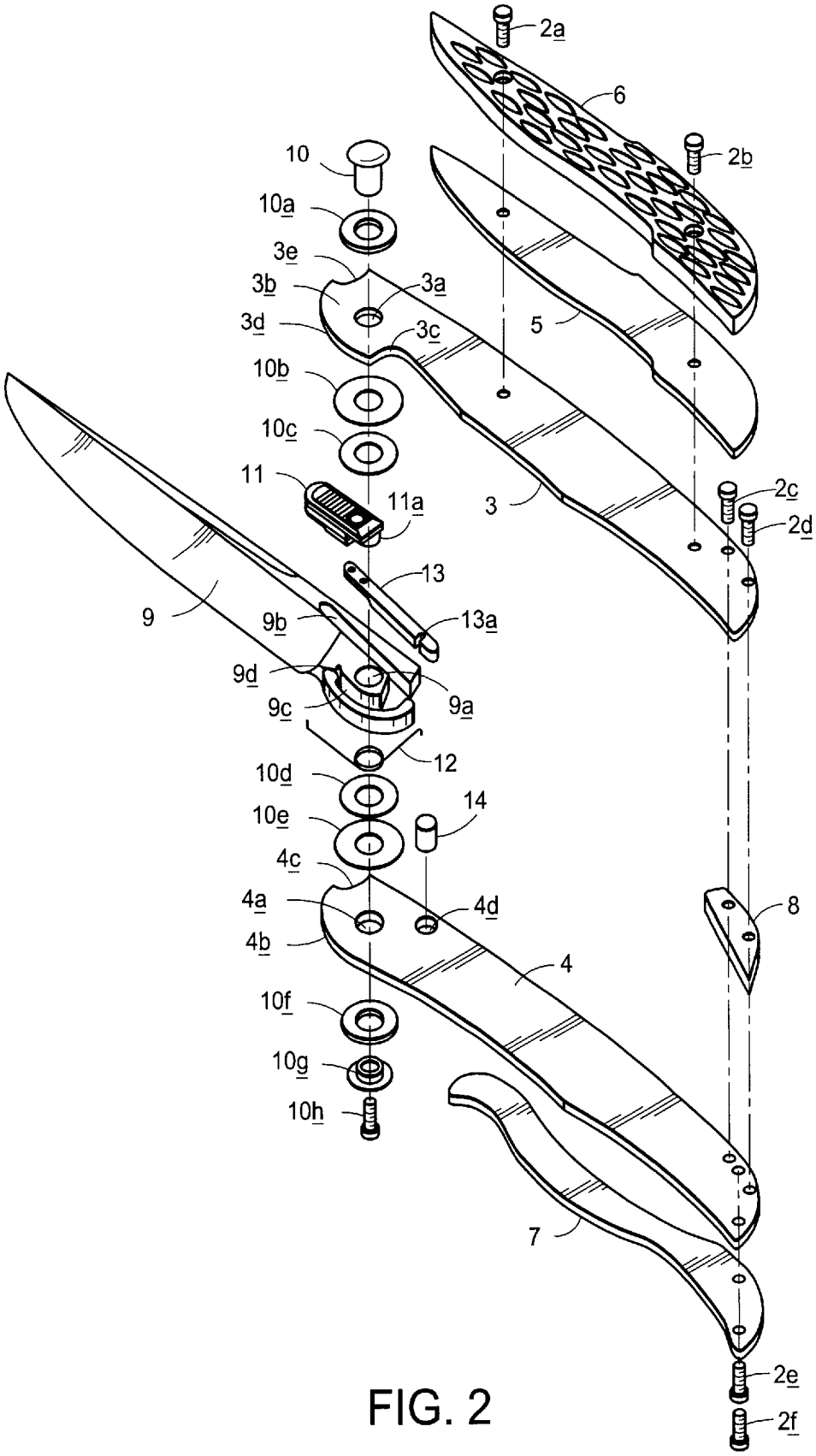
FIG. 2 is a view separated into every part in perspective of the present invention.

Below, a working configuration of the invention will be explained. FIG. 1(*a*) is a right side elevation of a knife having a locking system of the present invention. FIG. 1(*b*) is a front elevation of a knife having a locking system of the present invention. FIG. 2 is a view separated into every part in perspective of the present invention.

As show in FIG. 1 and FIG. 2, the knife having a locking system 1 of the present invention have a haft 2 and a blade 9, and is a knife of which the blade 9 is brought into or out of the haft 2 by revolving against the haft 2.

The haft 2 has a first side plate 3, a second side plate 4, a spacer 8, a reinforcement 5, an ornamental plate 6, and a clip 7.

The first side plate 3 and the second side plate 4 respectively consist of plates made up of unchangeable material such as metal, plastic and so on. Almost everything of the haft 2 is made up of the first side plate 3 and the second side plate 4. The first side plate 3 and the second side plate 4 are kept parallel at a fixed distance, and provide a space to accommodate the blade 9 between them, and become the whole frame of the haft 2. Around the upper edge of the lengthwise direction of each side plate (the first side plate 3 and the second side plate 4), axial holes 3*a*, 4*a* are made respectively toward the thicknesswise direction of each side plate in series. These axial holes 3*a*, 4*a* are the holes for an axial pin 10 (described later) being inserted in.

Around the axial hole 3*a* of the first side plate 3, an arc portion 3*d* is formed in arc shape. The region of the arc portion 3*d* being formed is from the front edge of the widthwise direction of the first side plate 3 to the upper edge of the lengthwise direction of the first side plate 3. In the front side of the widthwise direction of the first side plate 3, a first female portion 3*c* is formed in female shape next to the arc portion 3*d* in series.

And also in t he upper edge of the lengthwise direction of the first side plate 3, a second female portion 3*e* is formed in female shape next to the arc portion 3*d* in series. The position of the first female portion 3*c* is different about 180 degrees in angle around the axial pin 10 (described after) from the position of the second female portion 3*e*. The angle is almost equal to the angle of the blade 9 revolving from the state of being accommodated in the haft 2 till the state of being usable by a hand.

In this way, the first female portion 3*c*, the arc portion 3*d*, and the second female portion 3*e* formed in series around the axial hole 3*a* of the first side plate 3, become a guide 3*b* which guides a clasp 13 (described after) in the process of the blade 9 being brought out of the haft 2 and being fixed to the haft 2 in usable condition by a hand.

Further, an arc portions 4*b* and a female portion 4*c* are formed on the second side plate 4 respectively responding to each position of the arc portion 3*d* and the second female portion 3*e* of the first side plate 3. The object of the arc portion 4*b* and the female portion 4*c* does not act like as a guide 3*b* which guides a clasp 13 described after. The shape consisted of the arc portion 4*b* and the female portion 4*c* is formed as such, so as to keep the balance of whole shape of the haft 2.

Figure 9:
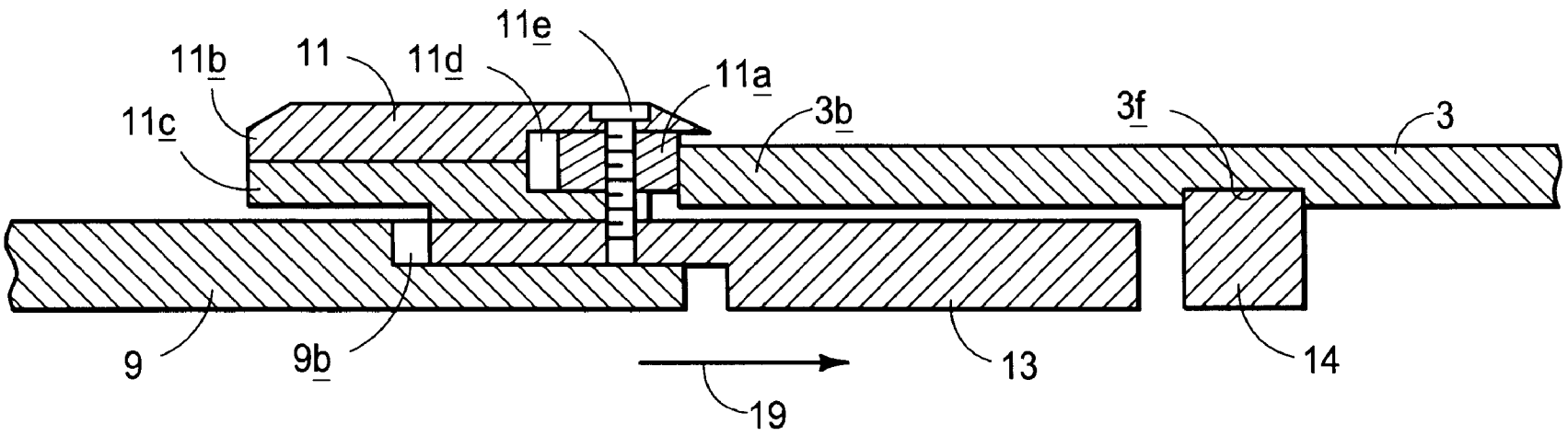
FIG. 9 is a partially enlarged section view of a knife having a locking system of the present invention showing the connection between the locking system and a guiding system.

Besides this, each surface of the first side plate 3 and the second side plate 4 face to face with each other, has respectively a female portion 3*f*, 4*d* formed in spot and female shape (the female portion 3*f* is shown in FIG. 9). Further, both the female portion 3*f* of the first side plate 3, and the female portion 4*d* of the second side plate 4 are located close to the back edge of the haft 2 respectively near the axial hole 3*a* and the axial hole 4*a* in which the axial pin 10 is inserted. The female portion 3*f* and the female portion 4*d* are face to face with each other. And a pin 14 lies between the female portion 3*f* and the female portion 4*d*. The pin 14 plays a role of fixing the blade 9 in usable position with the clasp 13 so as not to revolve.

As in a case of a typical knife, the blade 9 has an axial hole 9*a* for use in supporting itself to the haft 2 in revolvable state, near the end supported to the haft 2. Around the axial hole 9*a* of the blade 9, a guide portion 9*b* and an accommodator 9*c* are formed as system elements of fixing the blade 9 so as not to revolve in usable condition by a hand.

The guide portion 9*b* of the blade 9 is formed in line shape almost along the lengthwise direction of the blade 9, near the end supported to the haft 2. One end of the guide portion 9*b* is open toward outside from the end supported to the haft 2. Inside the guide portion 9*b*, lies a stick shaped clasp 13, of which the length is almost equal to the length of the guide portion 9*b*. The clasp 13 is supported so as to slide along the guide portion 9*b*.

The accommodator 9*c* is a vacant portion cut around the axial hole 9*a*. This vacant portion is connected to the open end of the guide portion 9*b* in series. At the end of the clasp 13 near the accommodator 9*c*, a female portion 13*a* is formed. At the closed end of the accommodator 9*c*, a female portion 9*d* is formed.

An L-shape spring 12 lies in the accommodator 9*c*. One end of the spring 12 is fixed to the female portion 9*d* of the accommodator 9*c*, and another end of the spring 12 is fixed to the female portion 13*a* of the clasp 13. And the spring 12 acts as a pushing element, which pushes the clasp 13 toward the open side of the guide portion 9*b*.

An axial pin 10 is inserted into the axial hole 3*a* of the first side plate 3, the axial hole 9*a* of the blade 9, and the axial hole 4*a* of the second side plate 4 in series. In this way, the blade 9 is supported to the first side plate 3 and the second side plate 4 in the condition of being revolvable on the axial pin 10. In addition to this, the upper edge of the lengthwise direction of each side plate (the first side plate 3, the second side plate 4), is fixed to each other by the axial pin 10. And the distance between the first side plate 3 and the second side plate 4 is kept in size of accommodating the blade 9 between them.

By the way, a washer 10*a* lies between the head of the axial pin 10 and the first side plate 3. A washer 10*b* and a friction decrease washer 10*c* lie between first side plate 3 and the blade 9. And a friction decrease washer 10*d* and a washer 10*e* between the blade 9 and the second side plate 4. The axial pin 10 is also inserted into the washer 10*a*; the washer 10*b*, the washer 10*e*, the friction decrease washer

10*c*, and the friction decrease washer 10*d* in series. In addition to this, the axial pin 10 is inserted into the washer 10*f*, and the ornamental washer 10*g* after jutting out of the second side plate 4, and a screw 10*h* is fixed to the lower end of the axial pin 10 by revolving. In this way, these elements are connected in series. Especially the friction decrease washer 10*c* and the friction decrease washer 10*d* can make the blade 9 to revolve more smoothly by lying between the blade 9 and the first side plate 3, and between the blade 9 and the second side plate 4, respectively.

On the other hand, each end of the first side plate 3 and the second side plate 4 in lengthwise directions is fixed to each other with a spacer 8 lying between them. The thickness of the spacer 8 is almost equal to the thickness of the part of the blade 9 around the axial hole 9*a*. The whole size of the spacer 8 is much smaller than the first side plate 3 or the second side plate 4. The shape around the spacer 8 partially accords with the shape around the each end of first side plate 3, or the second side plate 4 in lengthwise direction. The first side plate 3, the spacer 8, and the second side plate 4 are fixed by the screw 2*c* and the screw 2*d* in a state of each same-shape part being accorded with each other.

In addition to this, a reinforcement 5 and an ornamental plate 6 are fixed in series to the outside of the first side plate 3 by the screw 2*a* and the screw 2*b*. The whole haft 2 is reinforced by the reinforcement 5. The ornamental plate 6 improves the appearance of the whole haft 2 and makes the haft 2 to be held more easily by a hand.

On the outside of the second side plate 4, a clip 7 is fixed by a screw 2*e* and a screw 2*f*. The clip 7 not only supports the whole knife having a locking system 1 to a pocket of clothe, belt and so on by nipping, but also makes the haft 2 to be held more easily by a hand so as not to prevent the blade 9 being brought into or out of the haft 2. In brief, holding the haft 2 with putting a index finger, a middle finger, a ring finger and a little finger to the clip 7, can keep the route of the blade 9 being brought into or out of the haft 2 open at all times.

In addition to this, the clasp 13 is partially kept exposing without being covered with the first side plate 3 or the second side plate 4. On the exposing part of the clasp 13, an operation knob 11 is fixed. The operation knob 11 is located within the region which the operation knob 11 can be operated by the thumb of a hand holding the haft 2. So, according to the direction of the force added to the operation knob 11 by the thumb, the clasp 13 can be moved parallel, and the blade 9 can be revolved against the haft 2.

As the clasp 13 is pushed toward a open side of the guide portion 9*b*, the operation knob 11 fixed to the clasp 13 is pushed toward the axial pin 10 which is a revolving axle of the blade 9, and the operation knob 11 is touched to the guide 3*b* of the first side plate 3. So, when the blade 9 is revolved, the operation knob 11 is touched to the guide 3*b* so as to be smoothly movable. But at the portion of the operation knob 11 touching to the guide 3*b*, the operation knob 11 has a roller 11*a* which has bearings inside, and the operation knob 11 touches to the guide 3*b* so as to be smoothly movable. For these reasons, touching of the operation knob 11 to the guide 3*b* does not prevent the blade 9 to revolve at all.

In accordance with the knife having a locking system 1 of the present invention, the blade 9 can be brought into or out of the haft 2 by operating the operation knob 11 with a thumb of a hand holding the haft 2. Similarly, the blade 9 can be kept not to revolve against the haft 2 easily only by operating the operation knob 11, when the blade 9 has been brought out of the haft 2 until the blade 9 is in usable condition by a hand.

Figure 3:
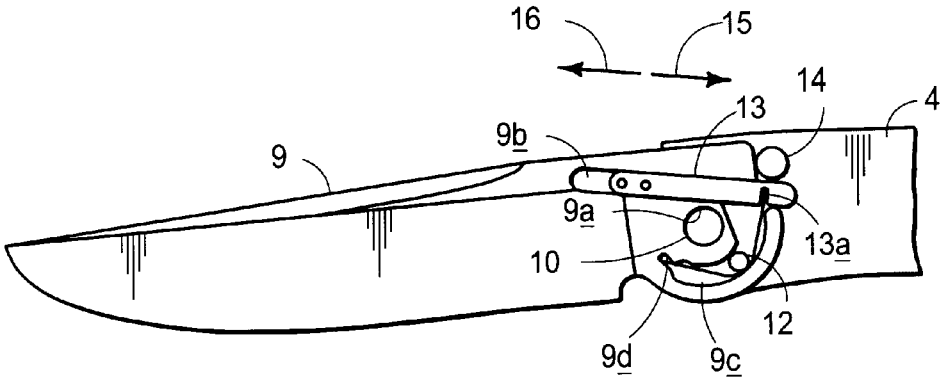
FIGS. 3 to 5 are respectively partially cutaway right side views of the present invention showing the locking system.
Figure 4:
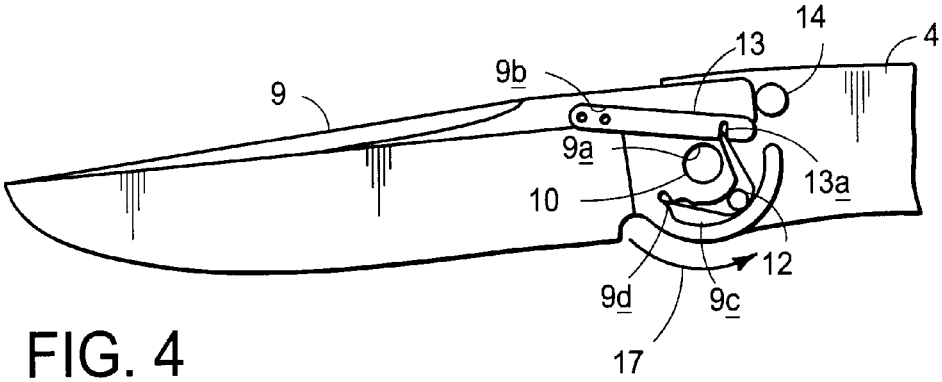
Figure 5:
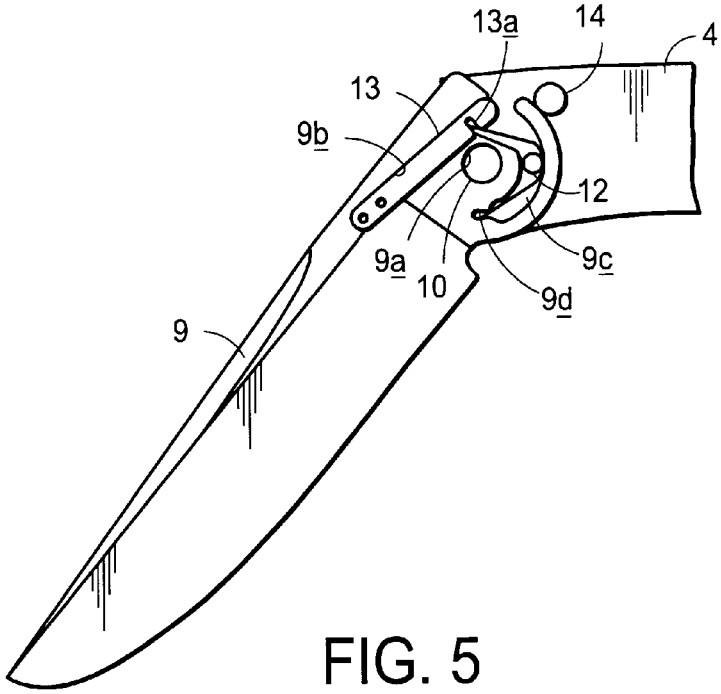

Next, the action and effect of the knife having a locking system 1 of the present invention will be explained in detail. FIGS. 3 to 5 are respectively partially cutaway right side views of the present invention showing the locking system.

First, when the blade 9 has been brought out of the haft 2 until the blade 9 is in usable condition by a hand as being shown in FIG. 3, the end of the blade 9 supported to the haft 2 is touched to the pin 14, and the blade 9 is prevented to revolve toward the direction of being brought out of the haft 2. Also the clasp 13 juts out of the end of the blade 9 supported to the haft 2, and the side of the clasp 13 touched to the pin 14, thus the blade 9 is prevented to revolve toward the direction of being brought into the haft 2 also.

In brief, by the spring 12 the clasp 13 is pushed toward the direction, which the guide portion 9*b* is opened, and juts out of the end of the blade 9 supported, to the haft 2 as guided by an arrow 15. Then the relation between the position of the clasp 13 and the position of the pin 14 in the state of the blade 9 being in usable condition by a hand, makes the side of the clasp 13 to touch the pin 14 so as to prevent the blade 9 to revolve toward the direction of being brought into the haft 2. For this reason, the blade 9 will be fixed to the haft 2 so as not to revolve, after the blade 9 has been brought out of the haft 2 until in usable condition.

Next, for the purpose of bringing the blade 9 which has already brought out of the haft 2 until in the usable state by a hand, into the haft 2 again, we only slide the clasp 13 so as to be accommodated into the guide portion 9*b* as guided by an arrow 16, and release the pin 14 from the state of being fixed as shown in FIG. 4. After that, by adding force to the blade 9 toward the direction of being brought into the haft 2, the blade 9 will revolve so as to be brought into the haft 2 shown in FIG. 5, and the whole blade 9 will be brought into the haft 2 completely. Conversely, for the purpose of making the blade 9 to be brought out of the haft 2 and to be fixed so as not to revolve, we only do the converse operation as described before.

Figure 6:
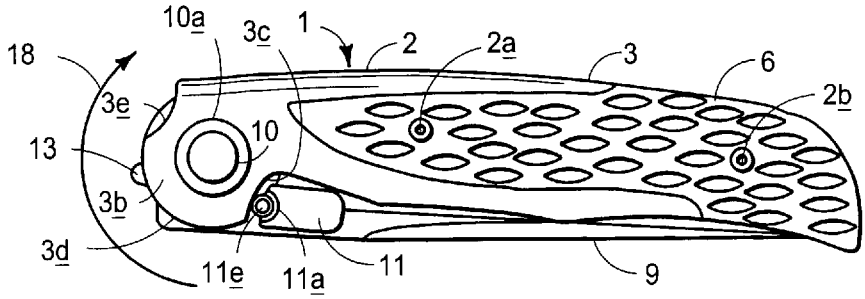
FIGS. 6 to 8 are respectively right side views of the present invention showing a guiding system.
Figure 7:
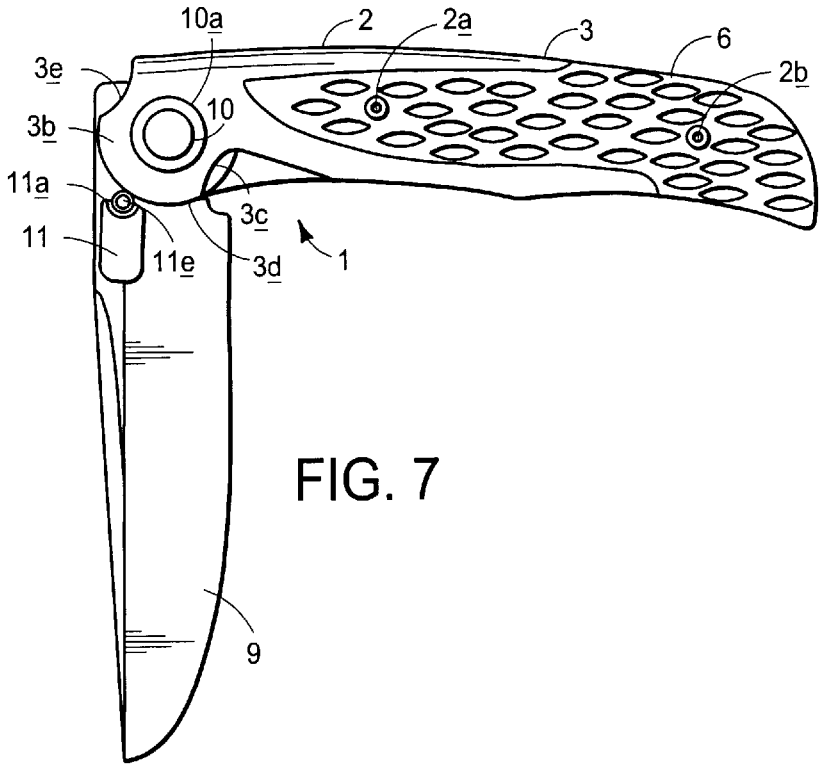
Figure 8:
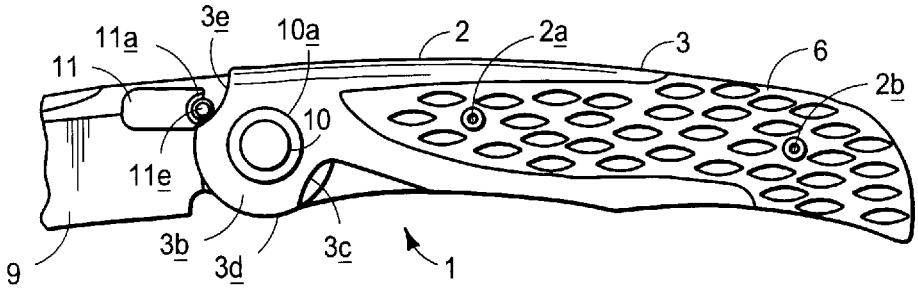

By the way, the knife having a locking system 1 of the present invention has a guiding system which prevents the clasp 13 from jutting out of the open side of the guide portion 9*b* responding to the revolving position of the blade 9. Next, this guiding system will be explained. FIGS. 6 to 8 are respectively right side views of the present invention showing a guiding system.

First, as shown in FIG. 6, in the state of the blade 9 being brought into the haft 2, the roller 11*a* of the operation knob 11 is kept to touch the first female portion 3*c* which is the part of the guide 3*b* formed around the axial hole 3*a*. In this state, if we will try to revolve the operation knob 11 toward the direction of the blade 9 being brought out of the haft 2 as guided by an arrow 18, the position of which the guide 3*b* is touched by the roller 11*a* will be moved from the first female portion 3*c* to the arc portion 3*d*. Then the operation knob 11 has to recede a little from the axial pin 10 in the distance. By the way, the direction which the clasp 13 is pushed by the spring 12 with the operation knob 11, is also the same direction which the roller 11*a* approaches the axial pin 10. Thus the operation knob 11 has to be pushed against the force of the spring 12 to recede from the axial pin 10 in the distance. Therefore, a little friction is produced between the haft 2 and the blade 9, when the blade 9 is brought out of the haft 2, especially at the moment when the position of which the guide 3*b* is touched by the roller 11*a* moves from the first female portion 3*c* to the arc portion 3*d*. And the blade 9 is fixed so as not to be brought out of the haft 2 when the knife is not used.

After that, during the blade 9 is brought out of the haft 2, the roller 11*a* is kept to touch the arc portion 3*d* so as to be smoothly movable. And the operation knob 11 is kept further than any other position from the axial pin 10, because the arc portion 3*d* is further than any other part of the guide 3*b* from the axial pin 10. Thus, while the roller 11*a* is touching the arc portion 3*d* so as to be smoothly movable, the rate of the clasp 13 in a body with the operation knob 11, being brought into the guide portion 9*b*, becomes the biggest. In fact, while the roller 11*a* is touching the arc portion 3*d* so as to be smoothly movable, sizes and positions of each part satisfy the condition that the whole clasp 13 is able to be brought into the guide portion 9*b*. And after the position of the roller 11*a* touching the guide 3*b* has moved from the arc portion 3*d* to the second female portion 3*e*, the roller 11*a* will approach the axial pin 10 again.

Then the clasp 13 in a body with the operation knob 11 will jut out of the open side of the guide portion 9*b* again. And the revolving position of the blade 9 at the moment of the clasp 13 jutting out, accords just with the revolving position of the blade 9 at the moment of the blade 9 having finished to be brought out of the haft 2. Accordingly, while the position of the roller 11*a* touching the guide 3*b* is moved from the arc portion 3*d* to the second female portion 3*e*, the state of the blade 9 being movable against the haft 2 can change into the state of the blade 9 being fixed to the haft 2, smoothly.

In brief, the guide 3*b* formed around the axial hole 3*a* of the first side plate 3, the roller 11*a* moving along the guide 3*b* in accordance with the revolving position of the blade 9 and connected to the clasp 13 with the operation knob 11, and the spring 12 pushing the clasp 13 toward the axial pin 10, compose a guiding system which guides the position of the clasp 13 against the guide portion 9*b* in accordance with the revolving state of the blade 9. And by the guiding system, the blade 9 can be fixed so as not to revolve against the haft 2 if the blade 9 is only brought out of the haft 2 which is in the state of being accommodated to in the state of being usable.

Therefore, while we use the knife having a locking system 1 of the present invention, the blade 9 can be brought out of the haft 2 until in usable state by a hand, and fixed against the haft 2, if we only add force to the operation knob 11 with the thumb of a hand holding the haft 2 toward the direction of the blade 9 being brought out of the haft 2. Conversely, while the blade 9 fixed in a usable state is brought into the haft 2, the direction added to the operation knob 11 so as to bring the blade 9 into the haft 2 accords with the direction of the force added to the operation knob 11 so as to release the clasp 13 from the state of being fixed to the pin 14, thus the blade 9 can be brought into the haft 2 if we only add force to the operation knob 11 toward the direction of the blade 9 being brought into the haft 2 .

The process described before to look through the section view of the important part of the knife having a locking system 1 is shown in FIG. 9 in detail. FIG. 9 is a partially enlarged section view of a knife having a locking system of the present invention showing the connection between the locking system and a guiding system. According to the FIG. 9, it is quite apparent at a glance what is shown as follows. The clasp 13 moving along the guide portion 9*b* of the blade 9 is in a body with the operation knob 11. The operation knob 11 is composed of two elements lying in vertical direction for example a upper plate 11*b* and a lower plate 11*c*, thus an accommodator 11*d* formed in the side of the operation knob 11 touching the guide 3*b* and the roller 11*a* is accommodated in the accommodator 11*d*. And the roller 11*a* is touched to the guide 3*b* so as to be smoothly movable. For these reasons, it is apparent that the position of the clasp 13 moving with the roller 11*a* and the operation knob 11 along the guide portion 9*b* responds to the revolving position of the blade 9. So, while the blade 9 is in a usable state, it is apparent that the side of the clasp 13 touches the pin 14 and the blade 9 is fixed against the haft 2 so as not to revolve, because the clasp 13 approaches the pin 14 as guided by an arrow 19.

Further, for the purpose of fixing the roller 11*a* to the operation knob 11, fixing the upper plate 11*b* to the lower plate 11*c*, and fixing the whole operation knob 11 to the clasp 13, a countermeasure has been taken; for example connecting the clasp 13, the operation knob 11, and the roller 11*a* in a body, by a screw 11*e* passing through the upper plate 11*b*, the axle of the roller 11*a*, the lower plate 11*c*, and the clasp 13 in series.

In this way, the knife having a locking system 1 of the present invention is a knife of which the blade 9 is brought into or out of a haft 2 by revolving against the haft 2, having a locking system fixing the blade 9 to the haft 2 in usable condition by a hand, characterized by an operation knob 11 attached to the blade 9 to operate the locking system.

According to the knife having a locking system 1 of the present invention, the operation knob 11 is attached to the blade 9 directly, thus a series of actions can be done that the blade 9 is brought into or out of a haft 2, the blade 9 is fixed to the haft 2 in usable condition by a hand, and the blade 9 is released from the state of being fixed to the haft 2, in accordance with a direction of the force added to the operation knob 11. Therefore, it can be done more easily to bring the blade 9 into or out of the haft 2.

Especially, the knife having a locking system 1 of the present invention is a knife, characterized by the operation knob 11 attached to a position where a hand holding the haft 2 can operate the operation knob 11.

According to the knife having a locking system 1 of the present invention, the operation knob 11 can be operated by the hand holding the haft 2, thus a series of actions can be done that the blade 9 is brought into or out of a haft 2, the blade 9 is fixed to the haft 2 in usable condition by the hand, and the blade 9 is released from the state of being fixed to the haft 2, only by one hand. Therefore, the use of the knife having a locking system 1 of the present invention is variable, for example, the other hand can be used for another purpose and so on.

In addition to this, the operation knob 11 of the knife having a locking system 1 of the present invention is attached to a position where a thumb of the hand holding the haft 2 can operate the operation knob 11.

According to the knife having a locking system 1 of the present invention, the operation knob 11 can be added force by a thumb which can move more easily and add more force than any other finger of the hand holding the haft 2. Therefore, the operation of the blade 9 can be done easily by one hand for the one whose grip is comparatively weak.

Besides, the action and release of the locking system of the knife having a locking system 1 of the present invention, are determined in accordance with a direction of the force added to the operation knob 11 so that the blade 9 can be brought into or out of the haft 2.

According to the knife having a locking system 1 of the present invention, the blade 9 can be brought out of the haft 2 and fixed to the haft 2 in usable condition by a hand only by adding force to operation knob 11 toward the direction of the blade 9 being brought out of the haft 2, conversely the blade 9 can be released from the state of being fixed to the haft 2 and brought into the haft 2 only by adding force to operation knob 11 toward the direction of the blade 9 being brought into the haft 2. Therefore, the operation of the blade 9 can be done more easily by one hand.

Analyzing more in detail, the knife having a locking system 1 of the present invention, is a knife of which the blade 9 is brought into or out of a haft 2 by revolving against the haft 2, characterized by: an operation knob 11 attached to a part of the blade 9 where the operation knob 11 can be operated by a thumb of a hand holding the haft 2; a clasp 13 supported to the blade 9 so as to be moved parallel far and near a revolving axle (axial pin 10) of the blade 9 in accordance with operations of the operation knob 11; a pin 14 which fixes the blade 9 so as not to revolve on the axle (axial pin 10) with the clasp 13 when the clasp 13 is moved near to the axle (axial pin 10) in condition that the blade 9 is in usable position of revolving; an arc portion 3*d* formed arc in shape round the axle (axial pin 10) at a part of the haft 2; a first female portion 3*c* formed female in shape next to the arc portion 3*d* in series toward a direction of the blade 9 being brought into the haft 2 by revolving; a second female portion 3*e* formed female in shape next to the arc portion 3*d* in series toward a direction of the blade 9 being brought out of the haft 2 by revolving; a guided element (roller 11*a*) touched to a guide consisted of the first female portion 3*c*, the arc portion 3*d*, and the second female portion 3*e* with the clasp 13 so as to be smoothly movable; and a pushing element (spring 12) pushing the clasp 13 toward the axle (axial pin 10).

According to the knife having a locking system 1 of the present invention, the clasp 13 is pushed toward the axle (axial pin 10) of the blade 9 by the pushing element (spring 12), and the guided element (roller 11*a*) touched to a guide 3*b* consisted of the first female portion 3*c*, the arc portion 3*d*, and the second female portion 3*e* with the clasp 13 so as to be smoothly movable, thus the guided element (roller 11*a*) is moved with the clasp 13 along the guide 3*b* in accordance with the locus of the blade 9 moving between the position where the blade 9 is brought into the haft 2, and the position where the blade 9 is brought out of the haft 2 in usable condition by a hand. Therefore, only by adding force to the operation knob 11 with a thumb of a hand holding the haft 2 toward the direction of the blade 9 being brought out of the haft 2, a series of actions can be done that the blade 9 is brought out of a haft 2 till in usable condition by a hand, and the blade 9 is fixed to the haft 2 so as not to revolve by means of the clasp 13 and the pin 14. Conversely, in the case of bringing the blade 9 into the haft 2, only by adding force with a thumb of a hand holding the haft 2 to the operation knob 11 toward the direction of the blade 9 being brought into the haft, a series of actions can be done that the blade 9 in usable state is released from the state of being fixed to the haft 2 by the clasp 13 and the pin 14, the blade 9 is brought into the haft 2, and the blade 9 is fixed to the haft 2 in the state of being accommodated in the haft 2.

By the way, as mentioned above, the operation knob 11 is located at the position where a thumb of a hand holding the haft 2 can reach to operate. The operation knob 11 can afford to be located at the position where another finger of the hand and so on can reach to operate.

Besides, as mentioned above, a roller 11*a* having bearings is selected as the guided element. But only the roller 11*a* is not selected as the guided element. Any element is afforded as the guided element, if the element has the qualities to decrease friction of being touched to the guide 3*b* so as to be smoothly movable, and to resist great many times of being touched to the guide 3*b* so as to be smoothly movable for the period of many years' use as a typical knife's life at least.

Further, as mentioned above, the guide 3*b* which guides the clasp 13 is formed on the first side plate 3, thus a knife which is used by a right hand is shown as a shape of the knife having a locking system 1. Therefore, the shape of the knife having a locking system 1 is not always selected as a right-handed knife. In brief, the guide 3*b* which guides the clasp 13 affords to be formed on the second side plate 4 and the knife having a locking system i affords to be a left-handed knife.

Besides, the reinforcement 5 and the ornamental plate 6 are fixed to the first side plate 3, and the clip 7 is fixed to the second side plate 4, thus the position where the reinforcement 5 and the ornamental plate 6 are fixed affords to change into the position where the clip 7 is fixed. Especially, the reinforcement 5, the ornamental plate 6 and the clip 7 afford to be formed in a body with the plate to which each element is fixed, respectively. Besides, if the strength of the whole haft 2 is kept necessary and sufficient at least, it is not always limited that the reinforcement 5 should be fixed to the first side plate 3 or the second side plate 4.

In addition to this, as mentioned above, though an L-shape spring 12 is used as a pushing element, which pushes the clasp 13, an L-shape spring 12 does not always have to be used as the pushing element. Besides, the position and the shape of the accommodator that accommodates the pushing element are not always limited to the position and the shape of the accommodator 9*c* that accommodates the spring 12. For example, the shape of the pushing element affords to be spiral, or another shape, if the pushing element can push the clasp 13 toward the objective direction. In accordance with different shapes of the pushing element as mentioned above, the position and the shape of the accommodator 9*c* become different.

Besides, as mentioned above, though the knife having a locking system 1 of the present invention has a guiding system which guides the clasp 13 toward the pin 14 in accordance with the revolving position of the blade 9, the knife having a locking system 1 does not always have to have the guiding system. If it were not for the guiding system, bringing the blade 9 into or out of the haft 2 and fixing the blade 9 to the haft 2 by one hand would be possible. But the knife having a locking system 1 should have the guiding system for the purpose of operating the operation knob 11 more easily.

Further, as mentioned above, the knife having a locking system 1 of the present invention has an operation knob 11 for use in the locking system in the blade 9. The operation knob 11 is located where a thumb of a hand holding the haft 2 can operate the operation knob 11. And the action and the release of the locking system are determined in accordance with a direction of the force added to the operation knob 11 toward the direction of the blade 9 being brought into or out of the haft 2. Though, the shape and the structure of each part are not always limited if the knife meets the conditions as mentioned above. In spite of the difference of the shape and the structure of each part of the knife, the knife has same effects as the knife having a locking system 1 of the present invention if the knife is formed same as mentioned above.

As set forth hereinabove, according to the knife having a locking system of claim 1 of the invention, the operation knob is attached to the blade directly, thus a series of actions can be done that the blade is brought into or out of a haft, the blade is fixed to the haft in usable condition by a hand, and the blade is released from the state of being fixed to the haft, in accordance with a direction of the force added to the operation knob. Therefore, it can be done more easily to bring the blade into or out of the haft.

According to the knife having a locking system of claim 2 of the invention, in addition to the same effect of a knife having a locking system of claim 1, the operation knob can be operated by the hand holding the haft, thus a series of actions can be done that the blade is brought into or out of a haft, the blade is fixed to the haft in usable condition by the hand, and the blade is released from the state of being fixed to the haft, only by one hand. Therefore, the use of the knife having a locking system of the invention is variable; for example, the other hand can be used for another purpose and so on.

According to the knife having a locking system of claim 3 of the invention, in addition to the same effect of a knife having a locking system of claim 2, the operation knob can be added force by a thumb which can move more easily and add more force than any other finger of the hand holding the haft. Therefore, the operation of the blade can be done easily by one hand for the one whose grip is comparatively weak.

According to the knife having a locking system of claim 4 of the invention, in addition to the same effect of a knife having a locking system of claims 1 through 3, the blade can be brought out of the haft and fixed to the haft in usable condition by a hand only by adding force to the operation knob toward the direction of the blade being brought out of the haft, conversely the blade can be released from the state of being fixed to the haft and brought into the haft only by adding force to the operation knob toward the direction of the blade being brought into the haft. Therefore, the operation of the blade can be done more easily by one hand.

According to the knife having a locking system of claim 5 of the invention, the guided element is moved with the clasp along the guide consisted of the first female portion, the arc portion, and the second female portion in accordance with the locus of the blade moving between the position where the blade is brought into the haft, and the position where the blade is brought out of the haft in usable condition by a hand. Therefore, only by adding force to the operation knob with a thumb of a hand holding the haft toward the direction of the blade being brought out of the haft, a series of actions can be done that the blade is brought out of a haft till in usable condition by a hand, and the blade is fixed to the haft so as not to revolve by means of the clasp and the pin. Conversely, in the case of bringing the blade into the haft, only by adding force with a thumb of a hand holding the haft to the operation knob toward the direction of the blade being brought into the haft, a series of actions can be done that the blade in usable state is released from the state of being fixed to the haft by the clasp and the pin, the blade is brought into the haft, and the blade is fixed to the haft in the state of being accommodated in the haft.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A knife, comprising:

a haft;

a blade pivotally mounted to the haft such that the blade may be selectively pivoted between a position inside the haft and a usable position outside the haft, the blade including opposing sides;

a locking system disposed on the blade, the locking system including a clasp movably coupled to the blade, wherein the clasp is movable along a direction generally parallel to the sides of the blade, and wherein the blade may be locked in the usable position outside the haft by moving the clasp to a locking position when the blade is in the useable position; and a member disposed within the haft, the member being configured to contact the clasp when the clasp is in the locking position to prevent the blade from pivoting out of the useable position, wherein the member is a pin disposed within the haft.

2. The knife of claim 1, farther comprising a spring coupled to the clasp to urge the clasp into the locking position.

3. The knife of claim 1, further comprising an operation knob coupled to the clasp, wherein the operation knob is adapted to be manipulated by a thumb of a hand holding the knife to move the clasp out of the locking position and to pivot the blade between the useable position and the position inside the haft.

4. The knife of claim 3, the haft including a first side plate and a second side plate, the first side plate having a rounded perimeter adjacent the blade, wherein the rounded perimeter urges the operation knob and clasp away from the locking position when the blade is pivoted between the useable position and the position inside the haft.

5. The knife of claim 4, wherein the rounded perimeter includes at least one notch configured such that the operation knob may be moved into the notch when the blade is located adjacent the notch, thereby placing the clasp in the locking position.

6. The knife of claim 5 wherein the notch is located on the rounded perimeter such that the operation knob may be moved into the notch when the blade is in the position inside the haft.

7. The knife of claim 5, wherein the notch is located on the rounded perimeter such that the operation knob may be moved into the notch when the blade is in the useable position.

8. The knife of claim 5, further comprising a spring coupled to the clasp, the spring being adapted to urge the operation knob against the rounded perimeter when the blade is pivoted between the position inside the haft and the useable position, and to urge the operation knob into the notch when the blade is located adjacent the notch.

9. The knife of claim 3, wherein the operation knob includes a bearing located on the operation knob such that the bearing contacts the rounded perimeter while the blade is pivoted between the useable position and the position inside the haft to reduce friction between the operation knob and the rounded perimeter during the pivoting of the blade.

10. A knife, comprising:

a haft, the haft including a first side plate and a second side plate;

a blade pivotally mounted to the haft such that the blade may be selectively pivoted between a position inside the haft and a useable position outside the haft, the blade further including opposing sides;

a member disposed within the haft between the first side plate and the second side plate such that a portion of the blade contacts the member when the blade is in the useable position to prevent the blade from pivoting past the useable position; and a locking system, the locking system including a clasp movably mounted to the blade, wherein the clasp is movable along a direction generally parallel to the sides of the blade, and wherein the blade may be locked in the usable position outside the haft by moving the clasp to a locking position when the blade is in the useable position, wherein the member includes a pin disposed within the haft between the first side plate and the second side plate.

11. A retractable knife, comprising:

a haft having a first side plate and a second side plate, the first side plate having a rounded perimeter;

a blade pivotally mounted to the haft such that the blade may be selectively pivoted between a useable position outside the haft and a position inside the haft, the blade including a groove-shaped guide formed in a portion of the blade adjacent the haft, the blade further including opposing sides;

a locking system, the locking system including a clasp slidably mounted within the groove-shaped guide, wherein the clasp is slidable along a direction generally parallel to the sides of the blade, and wherein the blade may be locked in the usable position outside the haft by sliding the clasp to a locking position when the blade is in the useable position;

a spring coupled to the clasp to urge the clasp into the locking position;

an operation knob coupled to the clasp, wherein the operation knob is adapted to be manipulated by a thumb of a hand holding the knife to move the clasp out of the locking position and to pivot the blade between the useable position and the position inside the haft, and wherein the operation knob contacts the rounded perimeter when the blade is moved between the useable position and the position inside the haft; and at least one notch formed in the rounded perimeter adjacent the useable position of the blade so that the operation knob may be urged into the notch by the spring when the blade is in the useable position to move the clasp into the locking position, thereby locking the blade in the useable position.

12. The knife of claim 10, wherein the clasp locks the blade in the useable position by contacting the member when the clasp is in the locking position to trap the member between the portion of the blade contacting the member and the clasp.

13. The knife of claim 10, wherein the blade includes a groove for guiding the clasp as the clasp is moved to and from the locking position.

14. The knife of claim 10, further comprising a spring coupled between the blade and the clasp, wherein the spring urges the clasp into the locking position.

* * * * *